US006866052B1

(12) United States Patent
Campos

(10) Patent No.: US 6,866,052 B1
(45) Date of Patent: Mar. 15, 2005

(54) PARTY DISPLAY ASSEMBLY

(76) Inventor: Lillian W. Campos, 307 Halstead Ave., Harrison, NY (US) 10528

( * ) Notice: Subject to any disclaimer, the term of this patent is extended or adjusted under 35 U.S.C. 154(b) by 55 days.

(21) Appl. No.: 10/619,118

(22) Filed: Jul. 15, 2003

(51) Int. Cl.[7] ..... A45B 3/00; A45B 25/18

(52) U.S. Cl. ..... 135/16; 135/15.1; 135/98; 135/33.2; 40/1

(58) Field of Search ..... 135/15.1, 16, 98, 135/33.2, 33.4; 211/197

(56) References Cited

U.S. PATENT DOCUMENTS

| | | | | | |
|---|---|---|---|---|---|
| 41,948 | A | | 3/1864 | Stewart | |
| 1,079,240 | A | * | 11/1913 | Henry | 135/33.41 |
| D158,765 | S | | 5/1950 | Katz | |
| 2,923,449 | A | * | 2/1960 | Sund | 223/69 |
| D223,789 | S | | 6/1972 | Economou | |
| 4,193,413 | A | * | 3/1980 | Watts et al. | 135/98 |
| 4,232,693 | A | * | 11/1980 | Matsuda | 135/33.2 |
| 4,294,350 | A | | 10/1981 | Haase et al. | |
| 4,527,721 | A | * | 7/1985 | Goldstein | 224/577 |
| 5,271,196 | A | * | 12/1993 | Fanti | 52/166 |
| 5,896,880 | A | | 4/1999 | Bushweller et al. | |
| 6,009,891 | A | * | 1/2000 | Surface et al. | 135/98 |
| 6,021,795 | A | * | 2/2000 | Long et al. | 135/98 |
| 6,244,283 | B1 | | 6/2001 | Ou | |
| 6,446,930 | B1 | * | 9/2002 | Li | 248/519 |
| 2001/0050097 | A1 | * | 12/2001 | Fazel | 135/15.1 |
| 2002/0108645 | A1 | * | 8/2002 | Beyer et al. | 135/33.2 |
| 2002/0185167 | A1 | * | 12/2002 | Lin et al. | 135/16 |

FOREIGN PATENT DOCUMENTS

| | | | | | |
|---|---|---|---|---|---|
| GB | 2222942 | A | * | 3/1990 | A45B/3/02 |

* cited by examiner

*Primary Examiner*—Robert Canfield

(57) ABSTRACT

A party display assembly for supporting a plurality of ornamental objects includes an elongated rod having an upper end and a lower end. A canopy has an upper surface and a lower surface. A coupler is attached to the lower surface for selectively coupling the upper end of the rod to the canopy. A plurality of fastening members is attached to the upper surface of the canopy for selectively fastening objects to the canopy.

12 Claims, 2 Drawing Sheets

PARTY DISPLAY ASSEMBLY

BACKGROUND OF THE INVENTION

1. Field of the Invention

The present invention relates to party display devices and more particularly pertains to a new party display device for supporting a plurality of decorative and ornamental objects which are tailored for particular festivities.

2. Description of the Prior Art

The use of party display devices is known in the prior art. While these devices fulfill their respective, particular objectives and requirements, the need remains for a device that is adapted for holding a plurality of decorative and ornamental objects which may be selectively chosen for their appropriateness relative to the festivity for which the device is to be used.

SUMMARY OF THE INVENTION

The present invention meets the needs presented above by generally including an elongated rod having an upper end and a lower end. A canopy has an upper surface and a lower surface. A coupler is attached to the lower surface for selectively coupling the upper end of the rod to the canopy. A plurality of fastening members is attached to the upper surface of the canopy for selectively fastening objects to the canopy.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
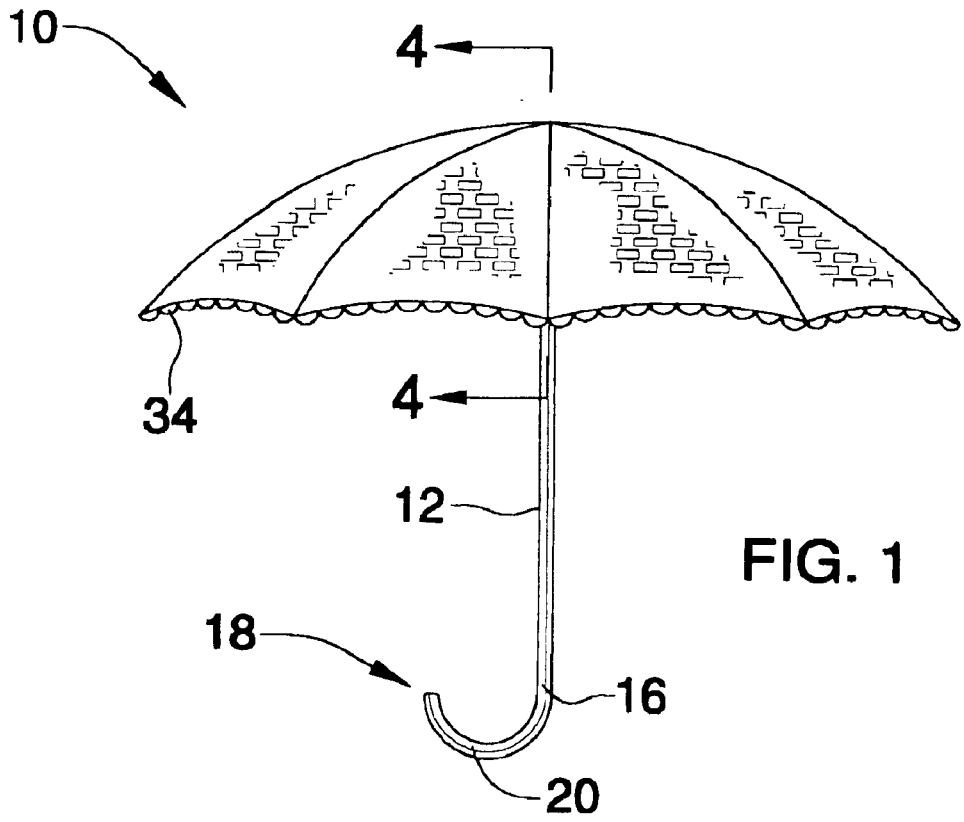
FIG. 1 is a schematic side view of a party display assembly according to the first embodiment of the present invention.
Figure 2:
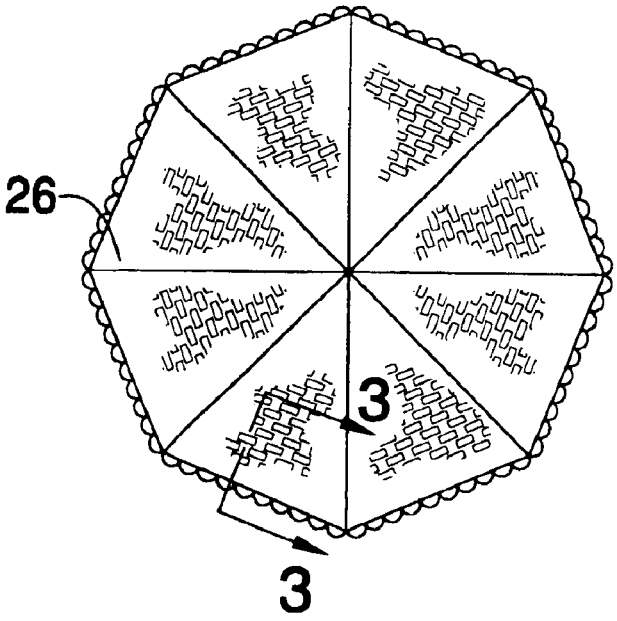
FIG. 2 is a schematic top view of the present invention.
Figure 3:
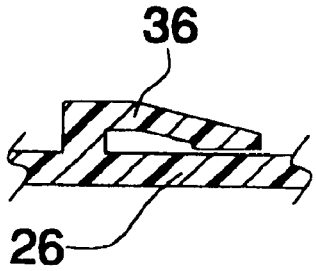
FIG. 3 is a schematic cross-sectional view taken along line 3—3 of FIG. 2 of the present invention.
Figure 4:
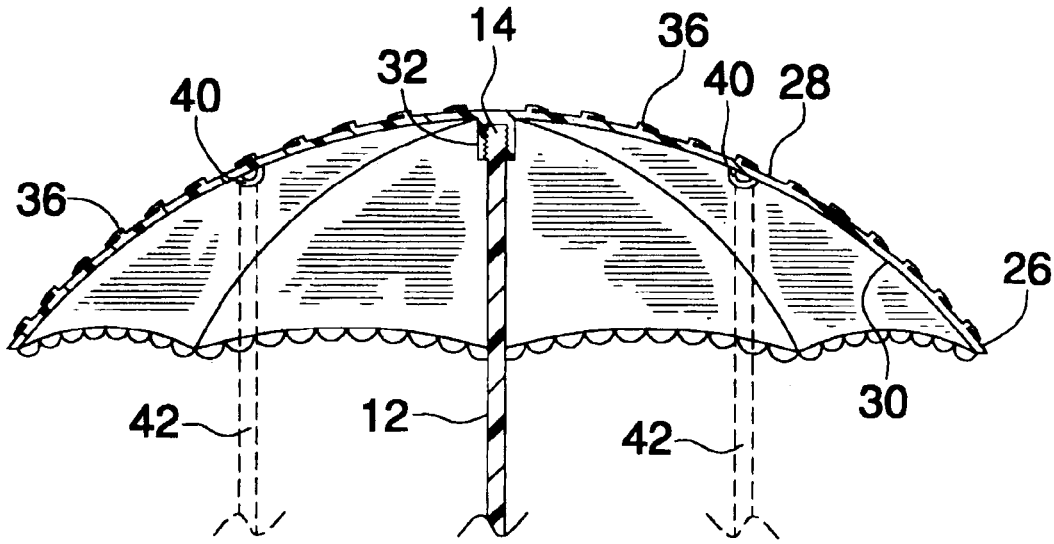
FIG. 4 is a schematic cross-sectional view taken along line 4—4 of FIG. 1 of the present invention.

With reference now to the drawings, and in particular to FIGS. 1 through 5 thereof, a new party display device embodying the principles and concepts of the present invention and generally designated by the reference numeral 10 will be described.

Figure 5:
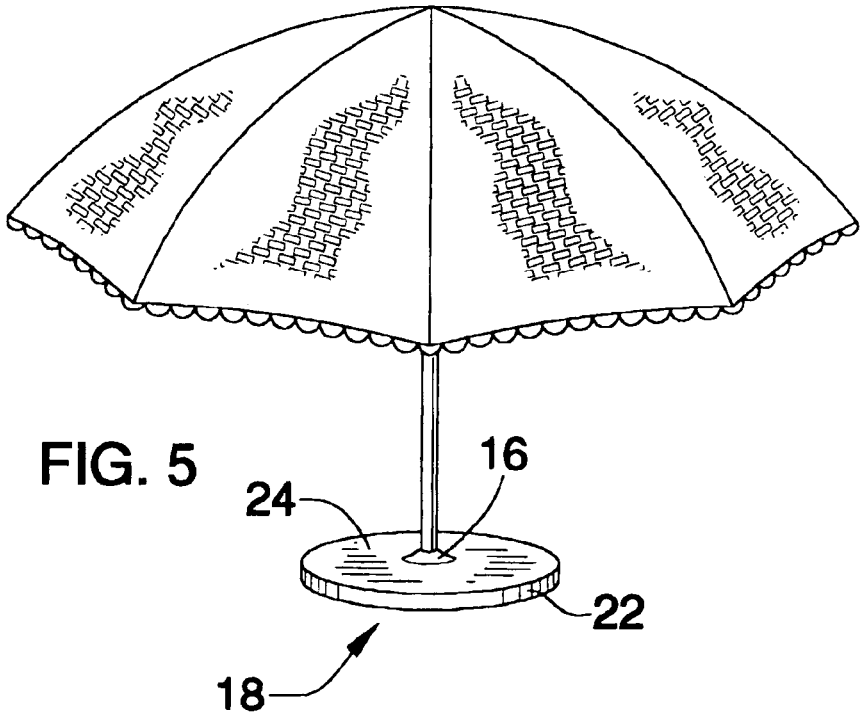
FIG. 5 is a schematic perspective view of a second embodiment present invention.

As best illustrated in FIGS. 1 through 5, the party display assembly 10 generally comprises an elongated rod 12 having an upper end 14 and a lower end 16. A base 18 is attached to the lower end 16 of the rod. The upper end 14 of the rod 12 is threaded. In the first embodiment, shown in FIG. 1, the base comprises 18 an arcuate handle 20 that generally has a J-shape. A second embodiment is shown in FIG. 5 and utilizes a panel 22 having a top side 24 which is attached to the lower end 16 of the rod 12. The rod 12 is orientated generally perpendicular to a plane of the panel 22.

A canopy 26 has an upper surface 28 and a lower surface 30. A coupler 32 is attached to the lower surface 30 for selectively coupling the upper end 14 of the rod 12 to the canopy 26. The coupler 32 preferably comprises a threaded female socket for threadably coupling with the upper end 14. The coupler 32 allows the use of different rods 12 having different bases 18. The canopy 26 ideally comprises a substantially rigid material. The rigid material is preferably a plastic material though wood, metal or other rigid materials may also be utilized. The canopy 26 preferably has the shape of a conventional umbrella canopy and has a perimeter edge having a decorative fringing 34 attached thereto.

A plurality of fastening members 36 is attached to the upper surface 28 of the canopy 26 for selectively fastening objects to the canopy 26. The objects may include bows, pictures, flowers, balloons or any other type of object which a user of the assembly 10 would want to display during a festivity. The plurality of fastening members 36 substantially covers the upper surface 28 of the canopy 26. Each of the plurality of fastening members 36 preferably comprises a clip biased downwardly toward the upper surface 28.

Rings 40, or other types of securing members, may be used for selectively attaching a ribbon 42 or other flexible elongated member to the canopy 26. Once the rod 12 has been removed, the canopy may then be worn as a hat.

In use, the assembly 10 is used an ornamental display during a party, holiday, or other festivity. The clips, or fastening members 36, are used for attaching items to the canopy 26 which may be of a symbolic nature with respect to the particular festivity or they may simply be of an ornamental purpose. Typically, gifts and other items would be placed under canopy 26. The base 18 may include a panel. 22 for positioning the assembly on a tabletop, or it may include a handle 20 for carrying such as during a bachelorette party.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

I claim:

1. A party display apparatus comprising:

an elongated rod having an upper end and a lower end;

a canopy having an upper surface and a lower surface, a coupler being attached to said lower surface for selectively coupling said upper end of said rod to said canopy; and a plurality of fastening members being attached to said upper surface of said canopy for selectively fastening objects to said canopy upper surface.

2. The party display apparatus of claim 1, further including a base being attached to said lower end.

3. The party display apparatus of claim 2, wherein said base comprises a handle.

4. The party display apparatus of claim 3, wherein said handle is arcuate and generally has a J-shape.

5. The party display apparatus of claim 1, wherein said base comprises a panel, said lower end of said rod being attached to and extending upwardly from a top side of said panel such that said rod is orientated generally perpendicular to a plane of said panel.

6. The party display apparatus of claim 1, wherein said upper end of said rod is threaded, said coupler comprising a threaded female socket for threadably coupling with said upper end.

7. The party display apparatus of claim 1, wherein said canopy comprising a substantially rigid material.

8. The party display apparatus of claim 7, wherein said plurality of fastening members substantially covers said upper surface of said canopy.

9. The party display apparatus of claim 8, wherein each of said plurality of fastening members comprises a clip biased downwardly toward said upper surface.

10. The party display apparatus of claim 1, wherein said plurality of fastening member substantially covers said upper surface of said canopy.

11. The party display apparatus of claim 10, wherein each of said plurality of fastening members comprises a clip biased downwardly toward said upper surface.

12. A party display apparatus comprising:

an elongated rod having an upper end and a lower end, a base being attached to said lower end, said upper end being threaded, said base comprising an arcuate handle generally having a J-shape;

a canopy having an upper surface and a lower surface, a coupler being attached to said lower surface for selectively coupling said upper end of said rod to said canopy, said coupler comprising a threaded female socket for threadably coupling with said upper end, said canopy comprising a substantially rigid material; and a plurality of fastening members being attached to said upper surface of said canopy for selectively fastening objects to said canopy, said plurality of fastening members substantially covering said upper surface of said canopy, each of said plurality of fastening members comprising a clip biased downwardly toward said upper surface.

* * * * *